US007141158B2

(12) United States Patent
Hong

(10) Patent No.: US 7,141,158 B2
(45) Date of Patent: Nov. 28, 2006

(54) DEBRIS SEPARATING APPARATUS FOR USE IN DOWNSPOUT BELOW AN EAVES TROUGH

(76) Inventor: Thomas K. Hong, 1666 Queen Street East, Unit 18, Toronto Ont. (CA) M4L 1G3

( * ) Notice: Subject to any disclaimer, the term of this patent is extended or adjusted under 35 U.S.C. 154(b) by 518 days.

(21) Appl. No.: 10/746,687

(22) Filed: Dec. 29, 2003

(65) Prior Publication Data

US 2005/0144852 A1 Jul. 7, 2005

(51) Int. Cl.
*E04D 13/076* (2006.01)

(52) U.S. Cl. ..... 210/156; 210/159; 210/162; 210/415; 210/446; 52/12; 52/16

(58) Field of Classification Search ..... 210/156, 210/159, 162, 413, 415, 446, 474; 52/11, 52/12, 16

See application file for complete search history.

(56) References Cited

U.S. PATENT DOCUMENTS 1,143,496 A * 6/1915 Briles ..... 210/156
1,794,504 A * 3/1931 Van Norman ..... 210/162
2,198,943 A * 4/1940 Lowe ..... 210/156
2,419,501 A * 4/1947 Pinto ..... 210/446
2,494,780 A * 1/1950 Schmidt ..... 210/162
4,801,377 A * 1/1989 Bolt ..... 210/162
5,526,612 A * 6/1996 Wade ..... 210/474
5,709,051 A * 1/1998 Mazziotti ..... 210/162
5,985,158 A * 11/1999 Tiderington ..... 52/12
6,219,972 B1 * 4/2001 Zusy ..... 52/12
6,263,618 B1 * 7/2001 Jones ..... 52/16
6,936,164 B1 * 8/2005 Wade ..... 210/159

* cited by examiner

*Primary Examiner*—Christopher Upton

(57) ABSTRACT

A debris separating apparatus for use in downspout below an eaves trough comprises a main housing having a water and debris inlet, a water outlet, and a debris outlet. A debris deflector mounted within the main housing between the water and debris inlet and the water outlet is sloped downwardly towards the debris outlet and has a plurality of parallel slots that permit water to pass from the water and debris inlet to the water outlet. A rotatable debris ejecting member has outwardly projecting fingers and water receiving receptacles mounted on the fingers. The debris ejecting member is rotatably mounted within the main housing beneath the debris deflector such that the outwardly projecting fingers project through the slots in the debris deflector and such that the outwardly projecting fingers travel along the slots in the debris deflector as the debris ejecting member rotates, to thereby eject debris accumulated on the top of the debris deflector.

14 Claims, 5 Drawing Sheets

DEBRIS SEPARATING APPARATUS FOR USE IN DOWNSPOUT BELOW AN EAVES TROUGH

FIELD OF THE INVENTION

The present invention relates to devices for ejecting debris from downspouts connected to the eaves troughs on buildings, and more particularly to such devices wherein the debris is automatically ejectd from the device.

BACKGROUND OF THE INVENTION

It is well known that the biggest problem with eaves troughs and downspouts on buildings, especially residential buildings having large trees adjacent thereto, is that of leaves and other debris clogging the eaves troughs and downspouts. It is very common for downspouts to be clogged enough to preclude significant water flow therethrough and also to cause a significant backup of debris. Typically, in order to clear such a clog of debris, it is necessary to either climb up a ladder, or even onto the roof of a building, which in many cases is highly undesirable, and is at least inconvenient.

If such clogging of leaves and other debris in a downspout and eaves trough is not cleared, water flow through the downspout is greatly reduced or even completely blocked. Resultingly, during a heavy rainstorm, rain water can spill out over the eaves trough, which is definitely undesirable, as it essentially negates the purpose of an eaves trough.

U.S. Pat. No. 5,985,158 issued Nov. 16, 1999 to Tiderington discloses a Removable Downspout Debris Trap Assembly. This assembly is for use with downspouts connected to a rain gutter system and is mounted within the downspout. The assembly has a strainer housing retained there within that permits trapping of leaves and other debris. The strainer housing is removable to permit the leaves and other debris to be emptied therefrom. Essentially, this debris trap assembly does not preclude the clogging of leaves and other debris in a downspout, it only makes the cleaning somewhat easier, but only if the cleaning is done very regularly so as to not clog the downspout above a point where this debris trap assembly exists.

It is an object of the present invention to provide a debris separating apparatus for use in a downspout below an eaves trough.

It is an object of the present invention to provide a debris separating apparatus for use in a downspout below an eaves trough, which debris separating apparatus automatically ejects leaves and other debris from being retained within.

SUMMARY OF THE INVENTION

In accordance with one aspect of the present invention there is disclosed a novel debris separating apparatus for use in downspout below an eaves trough. The debris separating apparatus comprises a main housing having a top end and a bottom end. A water and debris inlet is disposed in the main housing so as to be connectable in water an debris receiving relation to an opening in the bottom surface of a eaves trough, for permitting water and debris to enter the main housing through the water and debris inlet. A water outlet is disposed in the main housing so as to be connectable in water transfer relation to a downspout, for permitting water to exit the main housing. A debris outlet in the main housing permits debris to exit the main housing. A debris deflector is mounted within the main housing between the water and debris inlet and the water outlet so as to be sloped downwardly towards the debris outlet and having a plurality of parallel slots therein. The slots permit water to pass therethrough from the water and debris inlet to the water outlet. A rotatable debris ejecting member defines an axis of rotation and has a plurality of outwardly projecting fingers and water receiving receptacles mounted in offset relation to the axis of rotation. The rotatable debris ejecting member is rotatably mounted within the main housing beneath the debris deflector such that the outwardly projecting fingers project through the slots in the debris deflector and such that the outwardly projecting fingers travel along the slots in the debris deflector as the debris ejecting member rotates, to thereby eject debris accumulated on the top of the debris deflector.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the debris separating apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
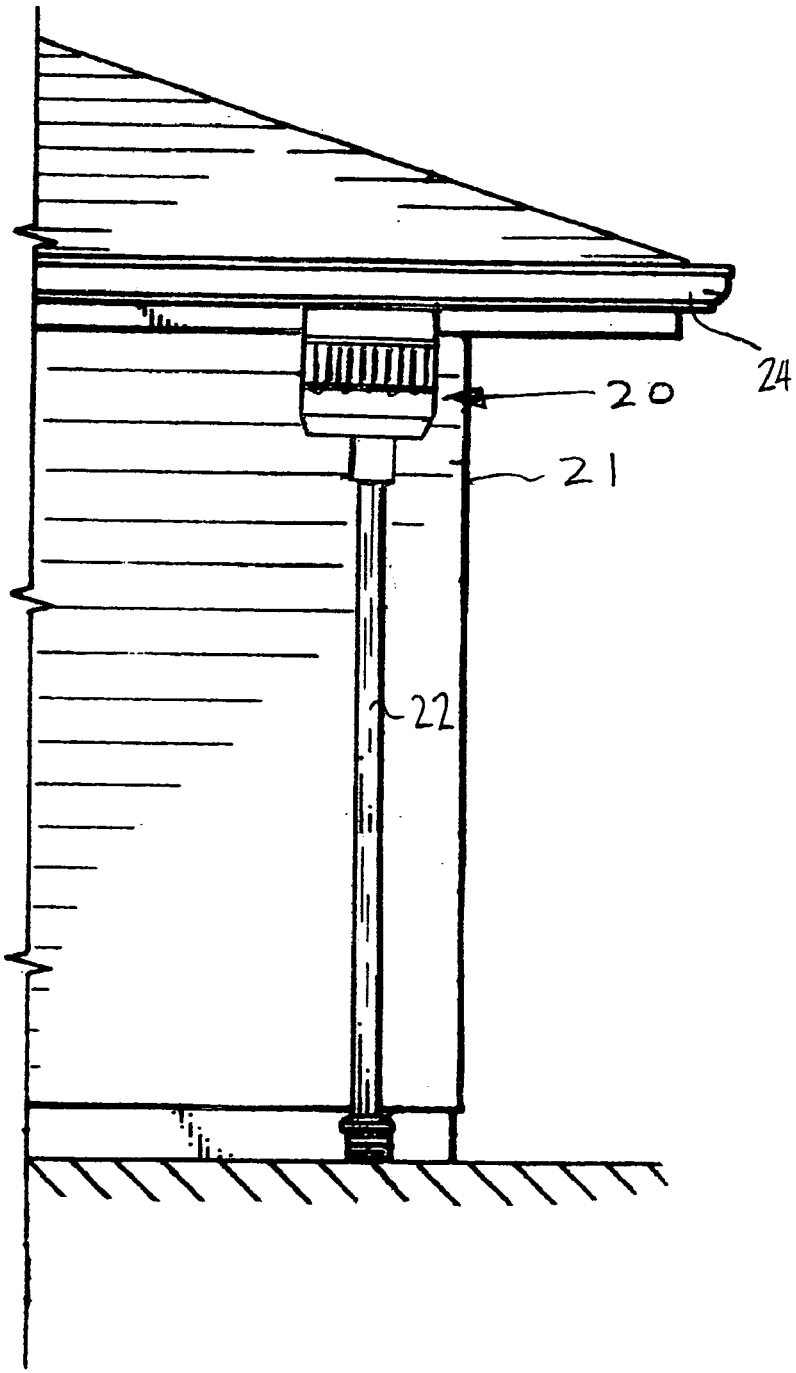
FIG. 1 is a front elevational view of the debris separating apparatus according to the present invention in place in a downspout.
Figure 2:
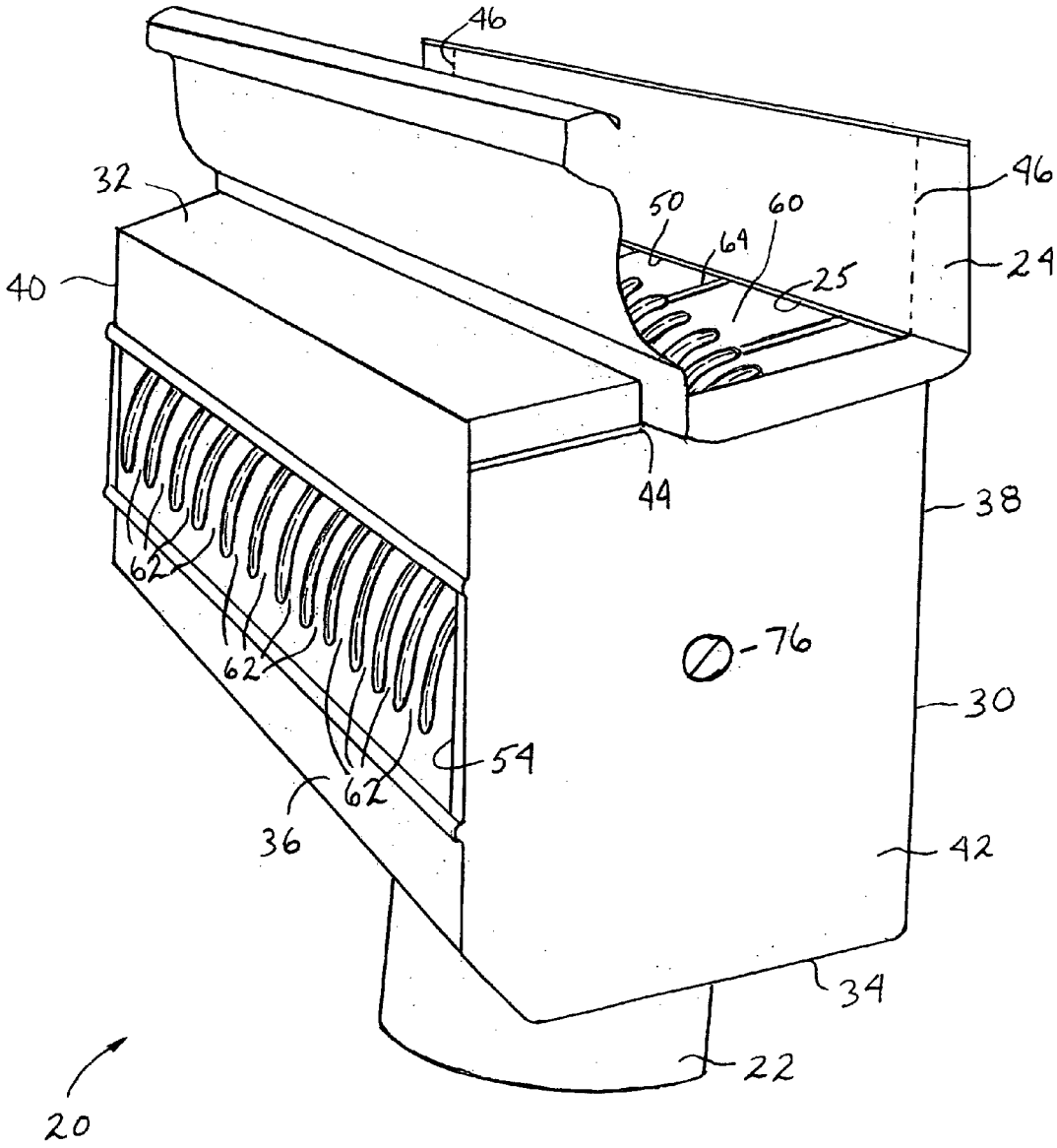
FIG. 2 is a perspective view of the debris separating apparatus of FIG. 1.
Figure 3:
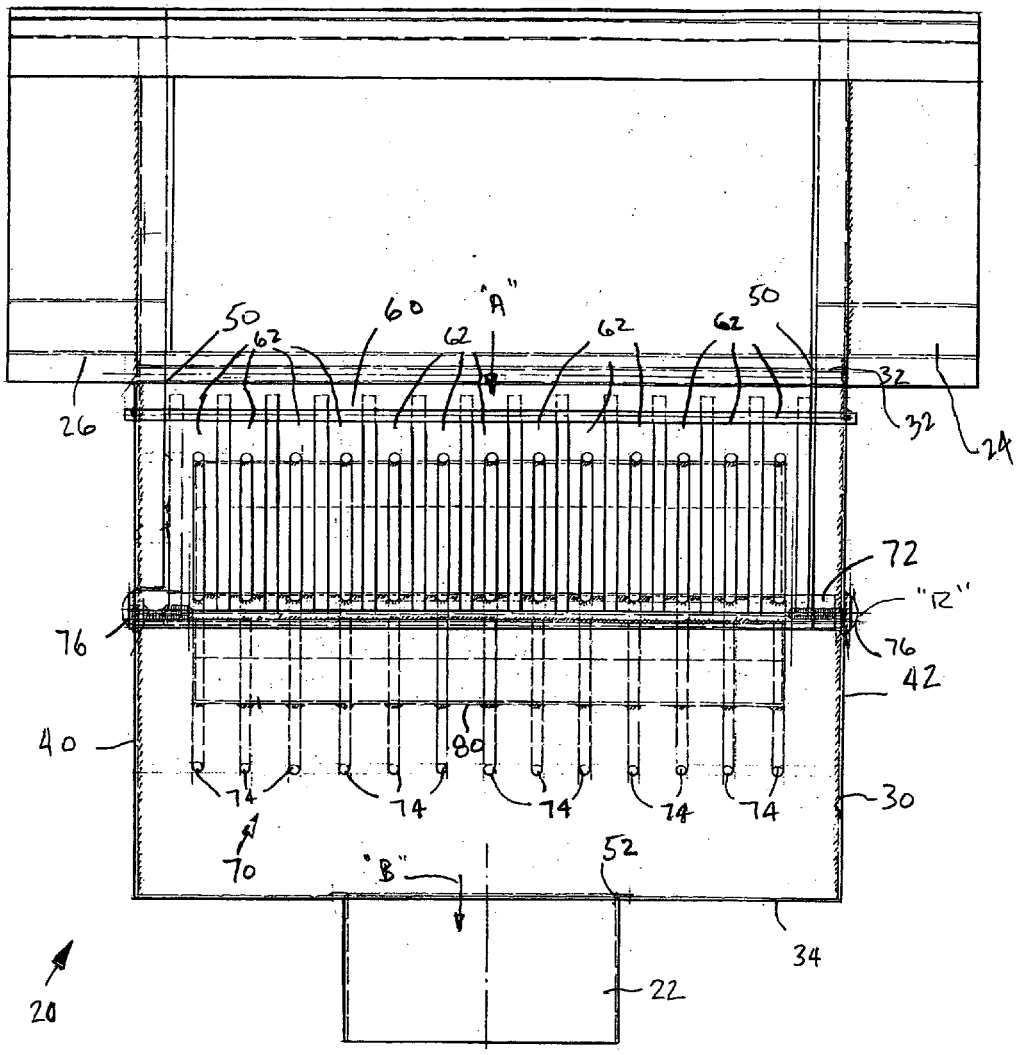
FIG. 3 is a sectional front elevational view of the debris separating apparatus of FIG. 1, taken along section line 3—3 of FIG. 2.
Figure 4:
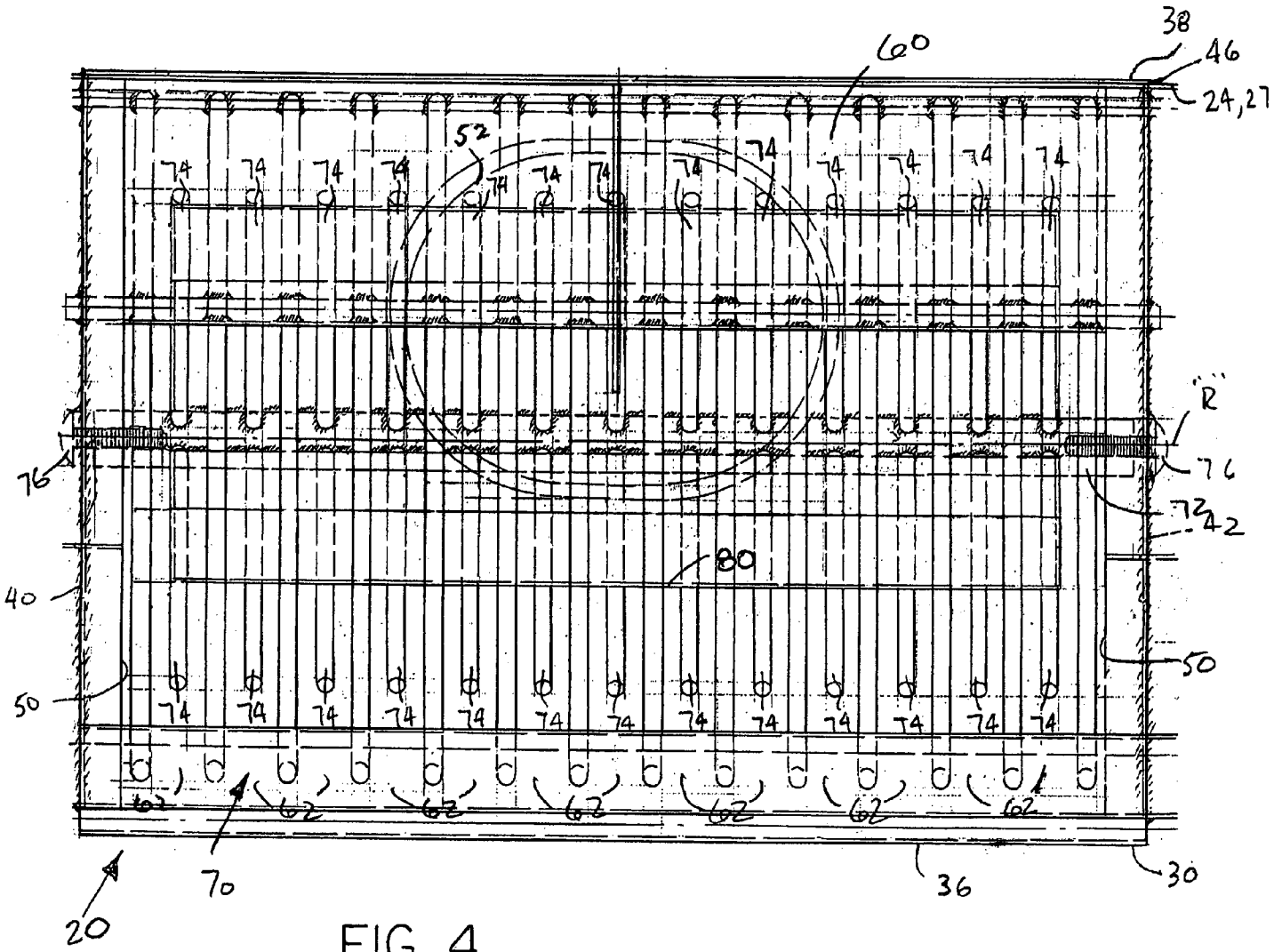
FIG. 4 is a sectional top plan view of the debris separating apparatus of FIG. 1, taken along section line 4—4 of FIG. 1; and, FIG. 5 is a sectional and elevational view of the debris separating apparatus of FIG. 1, taken along section line 5—5 of FIG. 2.

Reference will now be made to FIGS. 1 through 5, which show a first preferred embodiment of the debris separating apparatus according to the present invention, as indicated by general reference numeral 20. The debris separating apparatus 20 is for use in downspout 22 below an eaves trough 24 on a building 21. The debris separating apparatus 20 comprises, as can be best seen in FIG. 2, a main housing 30 having a top end 32, a bottom end 34, a front wall 36, a back wall 38, a left side wall 40, and a right side wall 42. There is also an upwardly facing channel 44 in the top end 32 of the main housing 30. The upwardly facing channel 44 is shaped and dimensioned to receive the bottom portion 26 of an eaves trough 24 therein. A substantially vertically disposed mounting plate 46 defines the back limit of the upwardly facing channel 44. The mounting plate 46 is for receiving the back wall 38 of the eaves trough 24 thereagainst. Preferably, the back wall 27 of the eaves trough 24 is secured to the substantially vertically disposed mounting plate 46 by means of threaded fasteners (not shown).

There is a water and debris inlet 50 in the top end 32 of the main housing 30. The water and debris inlet 50 is connectable in water an debris receiving relation to an opening 25 in the bottom surface of a eaves trough 24, for permitting water and debris to enter the main housing 30 through the water and debris inlet 50, as indicated by arrow "A" in FIG. 3.

There is also a water outlet 52 in the bottom end 34 of the main housing 30. The water outlet 52 is connectable in water transfer relation to a downspout 22, for permitting water to exit the main housing 30, as indicated by arrow "B" in FIG. 3.

There is also a debris outlet 54 in the front wall 36 of the main housing 30. The debris outlet 54 permits debris, such as leaves and the like, to exit the main housing 30 and fall to the ground.

A debris deflector 60 is mounted within the main housing 30 between the water and debris inlet 50 and the water outlet 52 so as to be sloped downwardly towards the debris outlet 54. The debris deflector 60 has a plurality of parallel slots 62 therein. The slots 62 permit water to pass therethrough from the water and debris inlet 50 to the water outlet 52. The debris deflector 60 comprises an upper plate portion 64 that deflects water that enters the main housing 30 through the water inlet 50. The slots 62 are in a lower portion below the upper plate portion 64.

A rotatable debris ejecting member 70 comprises a centre axle 72 and defines an axis of rotation "R" along the centre axle 72. The rotatable debris ejecting member 70 has a plurality of outwardly projecting fingers 74 secured to the centre axle 72. In the preferred embodiment, as illustrated, the fingers 74 of the rotatable debris ejecting member 70 are arranged in a pluralty of rows, specifically four rows, along the length of the center axle 72. The fingers 74 of the rotatable debris ejecting member 70 are substantially parallel one to another in each row. The rows of fingers 74 extend nearly the entire length of the centre axle 72, with a only a small portion of the centre axle 72 projecting beyond the rows of fingers 74, at each end of the centre axle 72. The centre axle 72 is retained in place by threaded fasteners 76 inserted through co-operating apertures in the left and right side walls 40,42 of the main housing 30.

Figure 5:
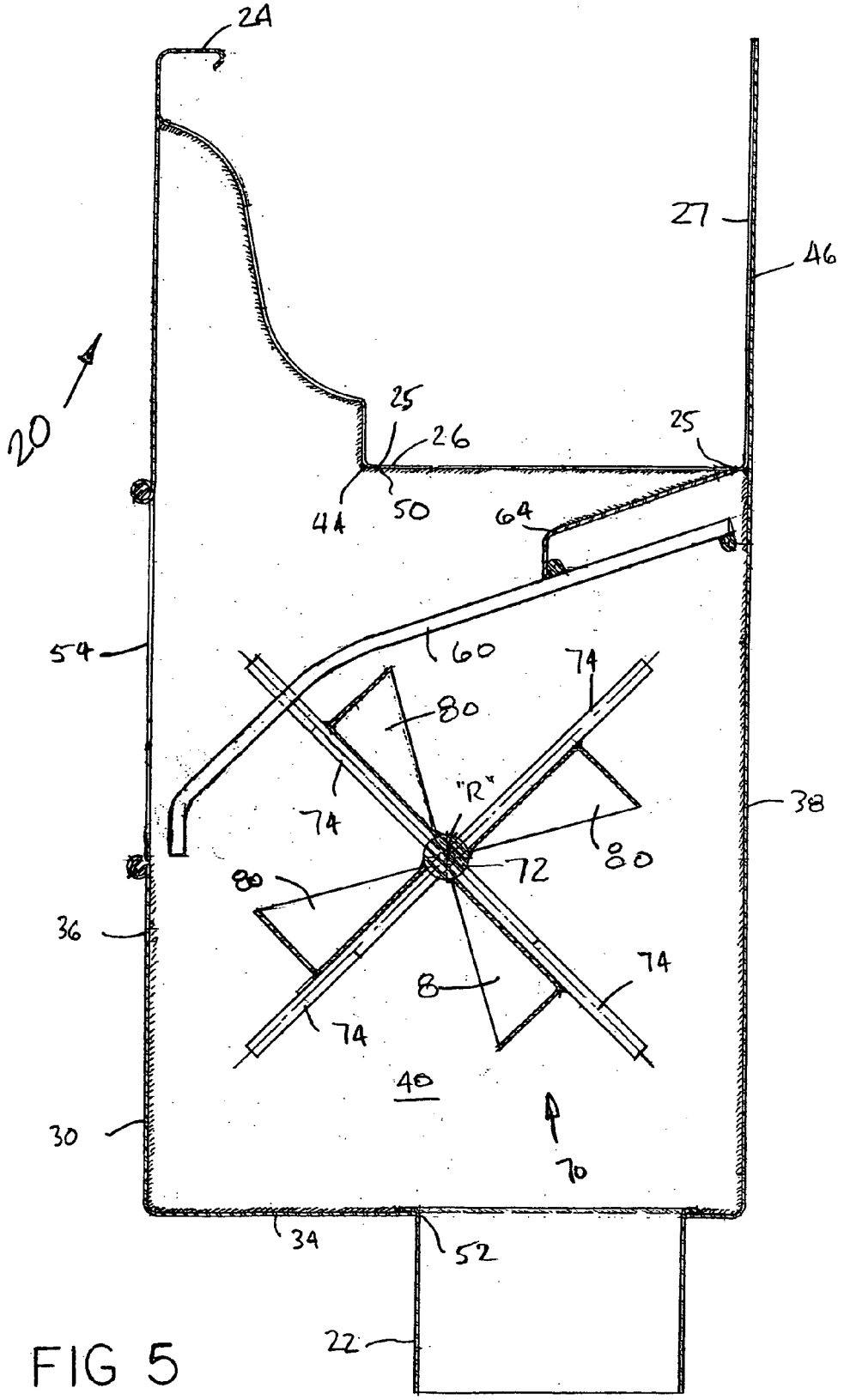

As can be best seen in FIG. 5, the debris deflector 60 is curved about the axis of rotation "R" of the rotatable debris ejecting member 70. Further, the rotatable debris ejecting member 70 is rotatably mounted within the main housing 30 beneath the debris deflector 60 such that the outwardly projecting fingers 74 project through the slots 62 in the debris deflector 60 and such that the outwardly projecting fingers 74 travel along the slots 62 in the debris deflector 60 as the debris ejecting member 70 rotates, to thereby remove debris accumulated on the top of the debris deflector 60.

Water receiving receptacles 80 are mounted on the fingers 74 of the rotatable debris ejecting member 70 such that the fingers 74 extend past the water receiving receptacles 80. There is one water receiving receptacle 80 mounted on each row of fingers 74. Each one water receiving receptacle 80 extends substantially the length of the respective row of fingers 74. As can be best seen in FIGS. 3 through 5, the water receiving receptacles 80 are mounted in offset relation to the axis of rotation "R". In this manner, when there is water in a water receiving receptacle 80, the weight of the water causes the rotatable debris ejecting member 70 to rotate such that the outwardly projecting fingers 74 travel along the slots 62 in the debris deflector 60. The upper plate portion 64 of the debris deflector 60 deflects water into the water receiving receptacles 80, but only as each water receiving receptacle 80 is disposed adjacent the debris outlet 54 and is facing substantially upwardly, thus causing the rotatable debris ejecting member 70 to rotate.

As can be understood from the above description and from the accompanying drawings, the present invention provides a debris separating apparatus for use in a downspout below an eaves trough, which debris separating apparatus automatically ejects leaves and other debris from being retained within, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the debris separating apparatus of the present invention without departing from the spirit and scope of the accompanying claims.

I claim:

1. A debris separating apparatus for use in downspout below an eaves trough, said debris separating apparatus comprising:

a main housing having a top end and a bottom end;

a water and debris inlet in said main housing connectable in water an debris receiving relation to an opening in the bottom surface of a eaves trough, for permitting water and debris to enter said main housing through said water and debris inlet;

a water outlet in said main housing connectable in water transfer relation to a downspout, for permitting water to exit said main housing;

a debris outlet in said main housing for permitting debris to exit said main housing;

a debris deflector mounted within said main housing between said water and debris inlet and said water outlet so as to be sloped downwardly towards said debris outlet and having a plurality of parallel slots therein, said slots for permitting water to pass therethrough from said water and debris inlet to said water outlet; and, a rotatable debris ejecting member defining an axis of rotation having a plurality of outwardly projecting fingers and water receiving receptacles mounted in offset relation to said axis of rotation;

wherein said rotatable debris ejecting member is rotatably mounted within said main housing beneath said debris deflector such that said outwardly projecting fingers project through said slots in said debris deflector and such that said outwardly projecting fingers travel along said slots in said debris deflector as said debris ejecting member rotates, to thereby eject debris accumulated on the top of said debris deflector.

2. The debris separating apparatus of claim 1, wherein said main housing further comprises a front wall, a back wall, a left side wall, and a right side wall.

3. The debris separating apparatus of claim 2, wherein said water and debris inlet is in said top end of said main housing.

4. The debris separating apparatus of claim 3, wherein said water outlet is in said bottom end of said main housing.

5. The debris separating apparatus of claim 4, wherein said debris outlet is in said front wall of said main housing.

6. The debris separating apparatus of claim 1, wherein said debris deflector is curved about said axis of rotation of said rotatable debris ejecting member.

7. The debris separating apparatus of claim 1, wherein said debris deflector comprises an upper plate portion and wherein said slots are in a lower portion.

8. The debris separating apparatus of claim 1, wherein said rotatable debris ejecting member comprises a centre axle, and said outwardly projecting fingers are secured to said centre axle.

9. The debris separating apparatus of claim 8, wherein said fingers of said rotatable debris ejecting member are arranged in a pluralty of rows along the length of said center axle.

10. The debris separating apparatus of claim 9, wherein said fingers of said rotatable debris ejecting member are substantially parallel one to another in each row.

11. The debris separating apparatus of claim 10, wherein said water receiving receptacles are mounted on said fingers of said rotatable debris ejecting member and said fingers extend past said water receiving receptacles.

12. The debris separating apparatus of claim 11, wherein there is one water receiving receptacle mounted on each row of fingers.

13. The debris separating apparatus of claim 1, further comprising an upwardly facing channel in the top end of said main housing, said channel being shaped and dimensioned to receive the bottom portion of an eaves trough therein.

14. The debris separating apparatus of claim 13, further comprising a substantially vertically disposed plate portion defining the back limit of said upwardly facing channel, said plate portion for receiving the back wall of an eaves trough thereagainst.

* * * * *